US005743524A

United States Patent [19]

Nannicola

[11] Patent Number: 5,743,524

[45] Date of Patent: Apr. 28, 1998

[54] SEAL CARD GAME WITH RANDOM ADVANCED PLAYER SELECTION

[76] Inventor: Charles A. Nannicola, 9216 Sunview Dr., Warren, Ohio 44484

[21] Appl. No.: 673,554

[22] Filed: Jul. 1, 1996

[51] Int. Cl.[6] ..... A63F 3/06; B42D 15/00

[52] U.S. Cl. ..... 273/139; 283/901; 283/903

[58] Field of Search ..... 273/139, 138 R, 273/269; 283/903, 901, 105, 103, 102, 101, 100, 98

[56] References Cited

U.S. PATENT DOCUMENTS

| | | |
|---|---|---|
| 3,900,219 | 8/1975 | D'Amato et al. . |
| 4,033,611 | 7/1977 | Johnsen . |
| 4,740,016 | 4/1988 | Konecny et al. . |
| 4,943,090 | 7/1990 | Fienberg . |
| 5,046,737 | 9/1991 | Fienberg . |
| 5,092,598 | 3/1992 | Kamille . |
| 5,128,293 | 7/1992 | Mullins . |
| 5,193,815 | 3/1993 | Pollard . |
| 5,407,200 | 4/1995 | Zalabak . |

*Primary Examiner*—William M. Pierce

*Attorney, Agent, or Firm*—Litman, McMahon, & Brown, L.L.C.

[57] ABSTRACT

A seal card game is provided which includes a set of individual play cards each having symbol combinations printed thereon and concealed under break-open windows. A plurality of the individual playing cards include symbol combinations which qualify their holders for advanced level play. The seal card includes a break-open window which conceals the identity of a seal winner, who is then entitled to play a next level. A plurality of advanced play levels are provided on the seal card and each level includes a plurality of windows. Each level includes a symbol which enables the previous player to proceed and other symbol combinations which identify other players who are entitled to play at the next level.

1 Claim, 3 Drawing Sheets

SEAL CARD GAME WITH RANDOM ADVANCED PLAYER SELECTION

BACKGROUND OF THE INVENTION

1. Field of the Invention

The present invention relates generally to game materials for playing games of chance for monetary prizes, and in particular to a break-open type card game with a seal card providing advanced, multiple play levels with random selection of advanced level players.

2. Description of the Related Art

Gaming for monetary and other prizes is very popular and generally involves the use of a game device or game materials for determining the game outcome. Game outcomes commonly comprise a combination of winner identification and prize (if any) determination.

Games of chance feature outcomes determined in whole or in part by chance. Such games can offer all players opportunities to win and thus have the potential for wider appeal than other types of games which involve elements of player skill and thus may deter participation by potential players with less skill or experience. Games of chance, particularly those involving monetary prizes, require security to ensure a profitable outcome for the operator and to instill player confidence.

Break-open game cards are often used for playing games of chance and generally comprise a predetermined number of cards, each having one or more sets of symbols printed thereon and each symbol set being concealed under a break-open window. Predetermined symbol combinations (e.g., three-of-a-kind, number combinations, etc.) are designated "winners" and are associated with particular prize amounts. Thus, game operators can reliably and precisely predict the profit from a set of game materials since only a predetermined number of cards will produce predetermined payouts. Security is provided by means of the break-open windows which effectively and completely conceal the hidden symbol combinations. Still further, the card surfaces are typically utilized for printing various designs and information thereon. Such printed information can include depictions of the winning game symbols and the payout amounts associated therewith.

Prior art examples of break-open game tickets are disclosed in the Konecny et al. U.S. Pat. No. 4,740,016, which shows a lottery ticket with multiple tear-open windows for selectively concealing symbol combinations, and in the D'Amato U.S. Pat. No. 3,900,219 which shows a document having markings concealed under detachable strips of an opaque cover sheet. The Johnson U.S. Pat. No. 4,033,611 discloses multi-ply lottery tickets comprising elongated material sheets with fold lines and tear strips for revealing hidden indicia.

A fund raising game can be played entirely with a set of break-open cards whereby all prizes are awarded to "instant" winners based upon symbol combinations on their respective tickets. Such break-open card games are relatively popular for fund raising purposes because they offer operators advantages of reliability, security, cards which are easy to sell and a highly predictable outcome in the form of total revenue taken in and a predetermined amount paid out in the form of prizes for a definite, predetermined profit amount and profit percentage.

The card counts, card prices and profit percentages can be adjusted as necessary to meet the requirements of regulatory agencies and state laws which govern such games in some states. Moreover, the printed cards and the promotional materials comprising "flares" and the like, which are typically sold therewith, can be printed with various designs, graphics, game identifying materials and the like for identifying the game and its source and for conveying other information about the game.

A popular variation involves one or more additional play levels involving the use of a seal card with a seal winner identified by indicia hidden under a removable seal. Such seal card games offer the advantages of providing extended play after all of the individual break-open card windows have been opened, thus providing players with yet another chance at winning. Player interest in following a game to its outcome can thus be maintained through an advanced play level involving the use of a seal window. Player interest can be further maintained by providing play levels beyond the initial seal winner. For example, the Feinberg U.S. Pat. No. 5,046,737 discloses games with seal winners determined from among prequalified players identified on a sign-up list, a bonus section and a jackpot section. The Zalabak U.S. Pat. No. 5,407,200 discloses multiple play levels with a diminishing number of players as each successive level and the group of advanced level players being determined from a player group whose names appear on a sign-up list. A disadvantage of such games is that only a relatively small number of players remain eligible for prizes, thus losing the interest of other players who have already been eliminated.

The seal card game of the present invention addresses some of the disadvantages of previous seal card games.

SUMMARY OF THE INVENTION

In the practice of the present invention, a game is provided which includes a set of individual play cards with multiple combinations of symbols printed thereon and selectively concealed under break-open windows. Some of the symbol combinations comprise advanced play level qualifying symbol combinations which entitle the cardholder to a chance at advanced play. A master seal card includes a seal window which selectively conceals a qualifying symbol combination for identifying a seal winner. The master seal card also includes multiple advanced play levels each having multiple seal windows, one of the seal windows in each advanced play level identifying a player opening same as a winner at that level and another seal window in the advanced play level identifying another advanced play qualified player as the winner at that level.

OBJECTS AND ADVANTAGES OF THE INVENTION

The principle objects and advantages of the present invention include providing a seal card game with break-open cards; providing such a seal card game with multiple instant winners identified by revealing hidden symbol combinations on said cards; providing such a seal card game wherein predetermined instant winners are qualified for advanced play; providing such a seal card game wherein advanced level qualified players sign up on an advanced play list for chances at opening seal card windows for advanced level prizes; providing such a seal card game which is adapted for playing for monetary and other prizes; providing such a seal card game which provides chances to win for all advanced level players throughout the duration of the advanced level play; providing such a seal card game which can be provided in various configurations with different ticket counts, instant winner amounts and advanced level winner amounts; providing such a seal card game which is adapted for manufacture with existing seal card manufacturing equipment; and providing a seal card game which enhances player interest and marketability.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
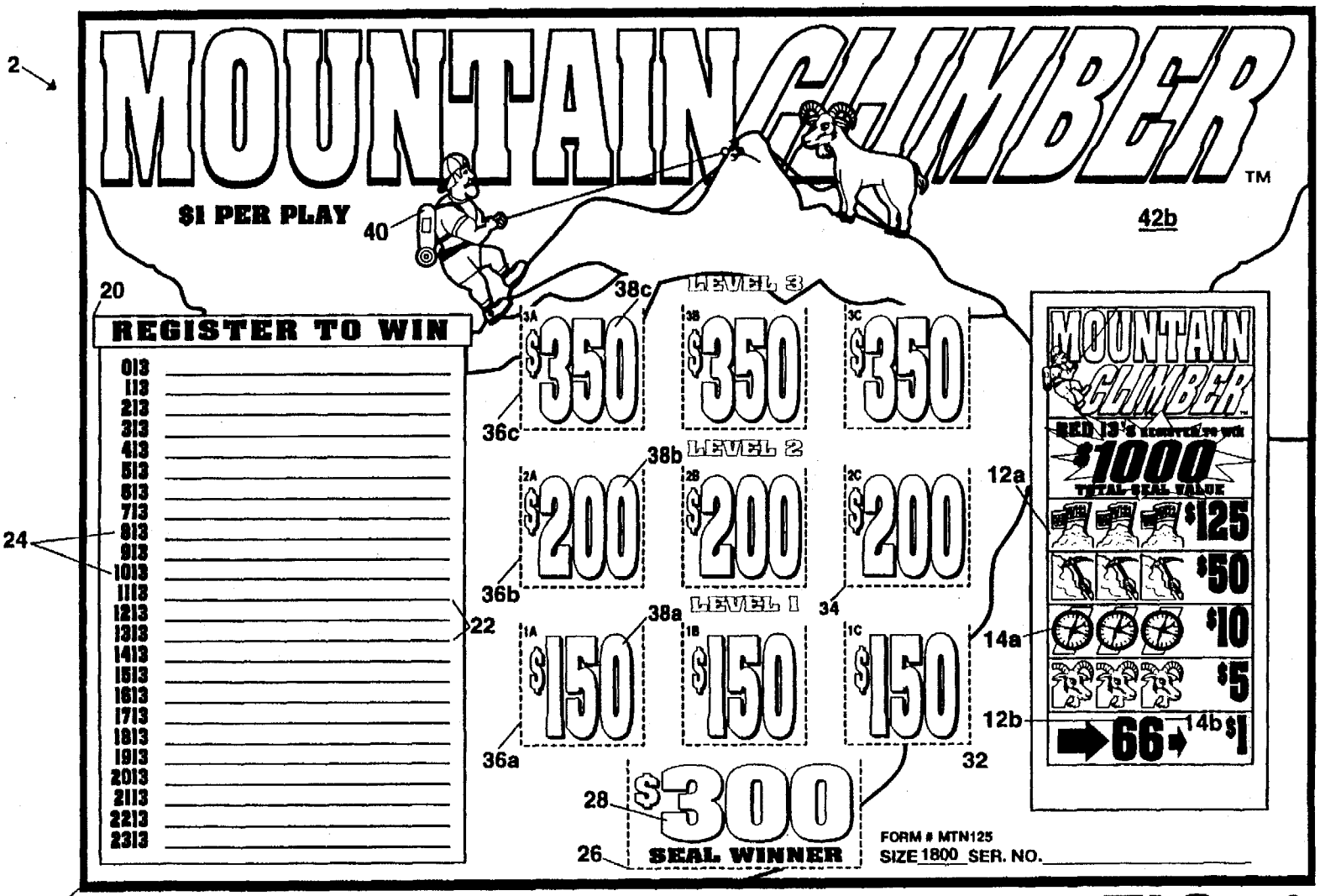
FIG. 1 is a front elevational view of a seal card for a seal card game embodying the present invention.
Figure 4:
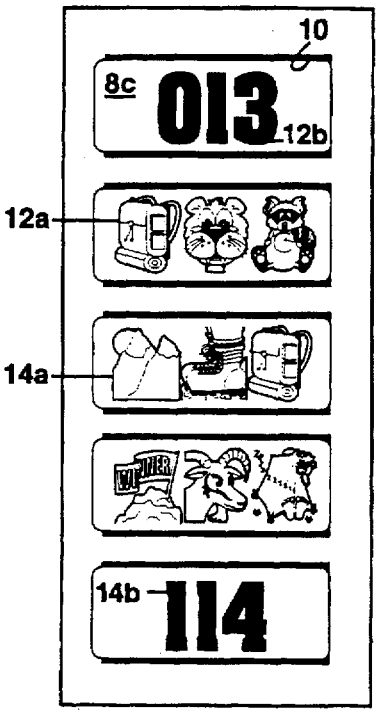
FIG. 4 is a rear elevational view of an another individual playing card, with symbol combinations printed thereon revealed.
Figure 3:
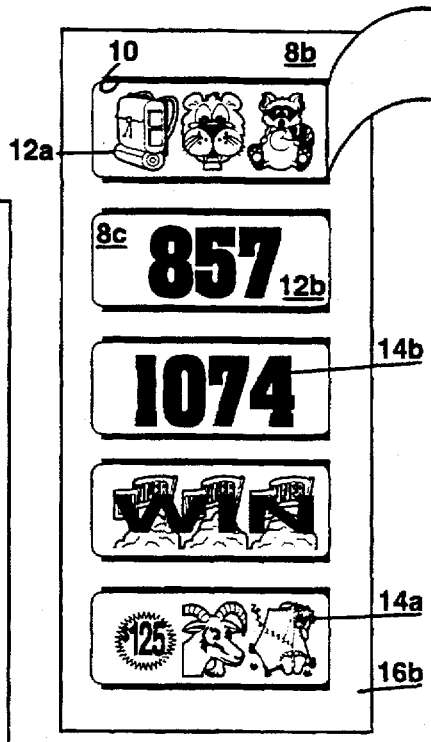
FIG. 3 is a rear elevational view of an individual playing card, with symbol combinations printed thereon revealed.
Figure 2:
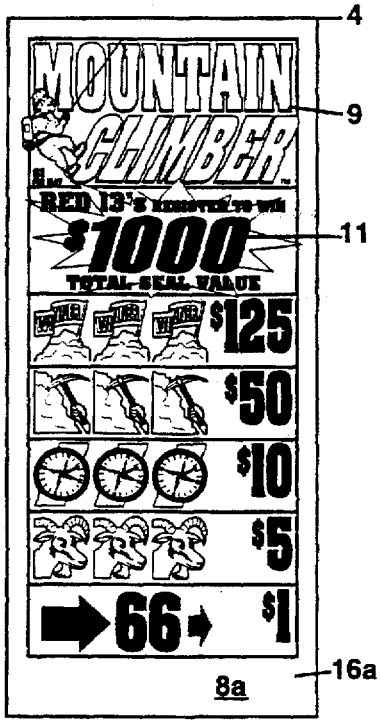
FIG. 2 is a front elevational view of an individual playing card.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 2 generally designates a seal card game for play by multiple players for multiple prizes, which embodies the present invention. The seal card game 2 comprises a collection of materials for playing same, which materials generally comprise a plurality of individual play cards or tickets 4 and a seal card 6.

II. Individual Play Cards 4

The game materials for the seal card game 2 can comprise a relatively large number of tickets, e.g., 1800 individual play cards or tickets 4. Alternatively, different sizes of the game 2 can be provided with different card counts, which correspond to the monetary parameters of the game, such as the total revenue generated thereby, payout/profit percentages and different prize amounts.

The disclosed embodiment of the seal card game 2 is intended for monetary play action whereby individual players purchase individual play cards 4 for chances at monetary prizes. However, alternative variations of games embodying the present invention could involve other types of play action, such as prizes consisting of goods or credits redeemable for goods or services.

Each individual play card 4 includes a front face **8*a* with promotional information 9 for identifying and promoting the game 2 and for defining predetermined combinations or groups 12 of winning game symbols 14, which will be explained in more detail hereinafter. For example, the front face 8*a* can identify a total seal value 11** amount (e.g., $1000) which a player could win.

The individual play card back faces 8b include multiple break-open windows 10, each concealing a respective combination 12 of symbols 14. For example, graphical combinations **12*a* of graphical symbols 14*a* comprise three symbols each, with certain predetermined symbol combinations (e.g., three-of-a-kind) being designated as instant winners and entitling the players holding such cards 4 to corresponding prizes displayed on the card front faces 8*a*. A break-open window 10 can also conceal numeric combinations 12*b* of numeric symbols 14*b*** comprising decimal digits.

Predetermined numeric combinations **12*b* can also be designated instant winners, e.g., numeric combinations 12*b* ending in predetermined numeric symbols 14*b*, such as "66". The individual play cards 4 shown have five windows 10 each, but cards with other numbers of windows could be utilized with the game 2 of the present invention. Moreover, a larger single window could be employed with multiple symbol combinations 12 thereunder as an alternative to the one-to-one correspondence of the windows 10 to the symbol combinations 12**.

The construction of the individual play cards 4 with the break-open windows 10 is well-known in the art and can be accomplished by laminating a front panel **16*a* with the front graphics printed on a front side or face 8*a* and the symbol combinations 12 printed on a covered side or face 8*c* of the front panel 16*a* which is covered by a back panel 16*b* with pull tabs 18 precut therein. The back panel 16*b* can then be secured in place (e.g., glued) onto the front panel 16*a* to provide an exposed back face 8*b*. The symbol combinations 12 printed on the front panel 16*a* covered side 8*c* are thus covered and concealed by the back panel 16*b* until the break-open windows 10 are opened by pulling open the pull tabs 18 to expose the symbol combinations 12. The printed symbol combinations 12 can also include designations such as "win" for identifying winning symbol combinations 12** and total instant winner amounts for providing security against alteration of the cards and for operator convenience in making payouts.

As alternatives to the break-open windows 10, other concealing means can be used, such as scratch-off types of coatings, foil seals, punchboards, etc.

The card game symbol combinations 12 provide an instant winner phase of the game 2 since players "instantly" know their prize amounts, if any, from this game phase upon opening the windows 10.

III. Seal Card 6

The seal card 6 provides an advanced phase of play action utilizing a sign-up register 20 with name lines 22 for players to record their names adjacent decimal registration numbers 24 corresponding to numeric symbols 14 found on respective individual play cards 4. In the disclosed embodiment, players with numeric combinations 12 ending in the decimal digits "13" (i.e., 013, 113, 213, . . . , 1913) qualify for advanced play and are entitled to record their names or signature or name lines 22 adjacent respective registration numbers 24. Preferably all of the name lines 22 are filled in prior to commencing advanced phase play.

Figure 5:
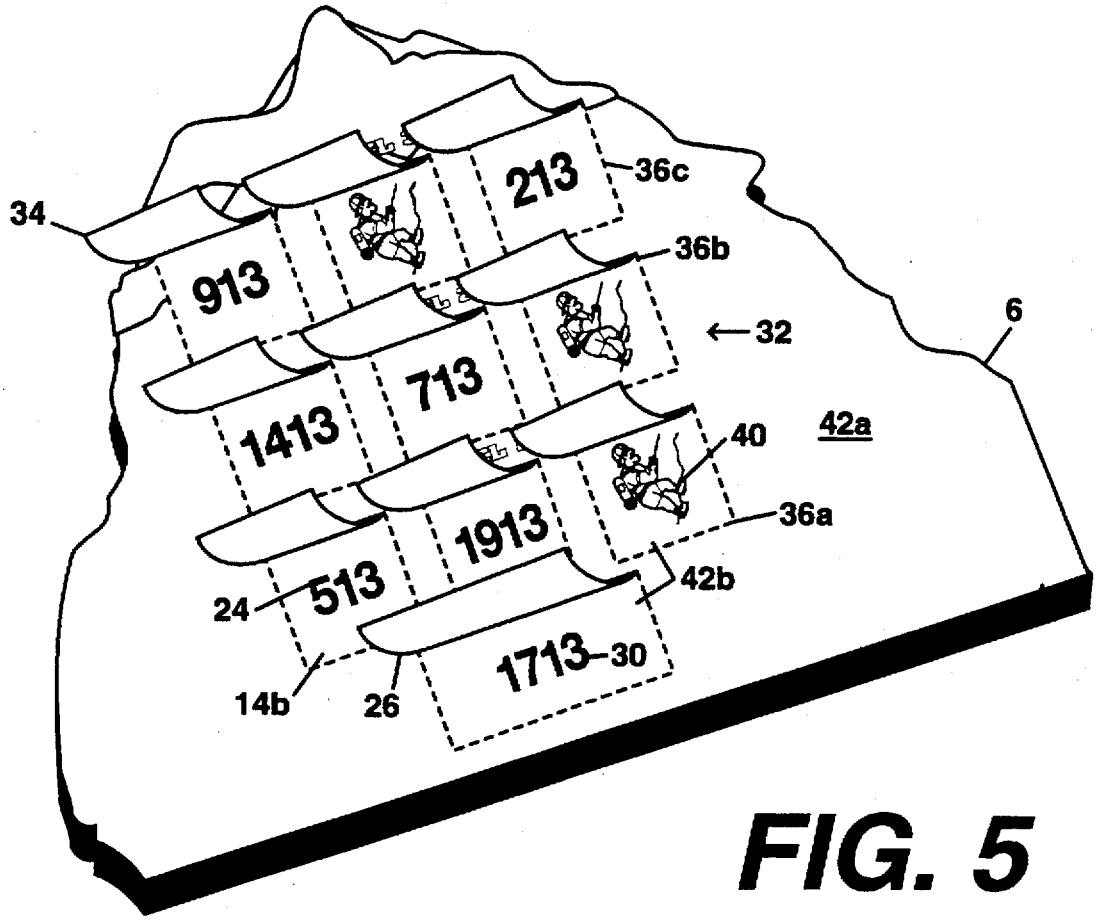
FIG. 5 is a fragmentary, front elevational view of the seal card with windows thereof opened to reveal the game outcome.

A seal window 26 has printed thereon a seal winner award amount 28 (e.g., $300) and operates in a manner similar to the break-open windows 10 described above, i.e., by tearing or peeling away an opaque cover to reveal indicia printed on an underlying layer. In the example of the seal window 26 shown in FIG. 5, the, seal winner registration number comprising a seal winner symbol combination 30 printed therebelow is 1713 and corresponds to one of the qualified player registration numbers 24, thus identifying one of the qualified players as the seal winner, whereupon that person becomes entitled to the $300 seal winner award 28.

The game materials 2 described thus far comprise a conventional break-open game with a sign-up register from which a seal winner is selected, of which numerous prior art examples exist.

IV. Advanced Hay Phase

The advanced play phase beyond the seal window 26 comprises a grid 32 of advanced level seal windows 34 organized in a 3×3 (or other size) grid with first, second and third levels or rows 36*a*, 36*b*, 36*c* comprising three advanced level seal windows 34 each. Each level 36*a*, 36*b*, 36*c* has advanced level prize amounts 38*a*, 38*b*, 38*c* printed thereon. Although these amounts can be relatively arbitrarily chosen, in the disclosed embodiment they increase upwardly through the seal window levels 36*a*, 36*b*, 36*c* which display award amounts of $150 (38*a*), 200 (38*b*) and (38*c*) $350 (38*c*) respectively.

Each advanced seal window level 36*a*, 36*b*, 36*c* conceals three hidden indicia under respective seal windows 34, two of which comprise registration numbers 24 other than the seal winner registration number 30, and one of which comprises an advance indicator comprising a win symbol (e.g., the "Mountain Climber" graphic symbol or icon) 40.

The seal winner, in addition to being entitled to the seal winner award 28, can be given a choice of one seal window 34 in the first level 36*a*. If the advance "Mountain Climber" symbol is selected, that player receives the first level award amount 38*a*(e.g., $150) and is entitled to play the second level 36*b*, whereupon the advanced level play repeats. Thus, the seal winner has a one in 27 (i.e., one in 3×3 ×3) chance of picking the advance symbol at all three levels.

If an advanced level seal window 34 is opened which has a registration number 24 thereunder, the player with that registration number receives the respective award amount 38*a*, 38*b*, 38*c* and is entitled to advance to the next advanced play level. Thus, as many as four players can participate in and receive prizes in the advanced play phase, one seal winner and three additional winners at the advanced levels 36*a*, 36*b*, 36*c*.

V. Game Method

A method of playing the game 2 is disclosed which includes the steps of playing a plurality of individual play cards 4 by opening their respective break-open windows 10. Instant winners are identified by graphic and numeric symbol combinations 12*a,b* on their individual play cards 4 under the break-open windows 10 thereof, whereupon appropriate instant winner prizes can be awarded in monetary or some other form.

Players with advanced level qualifying indicia such as the registration numbers 24 comprising numeric combinations 12*b* printed on their cards 4, qualify for advanced play and can record their names on the sign-up register 20 opposite their respective registration numbers 24. Preferably all of the individual play cards 4 are played prior to opening the seal window 26, or at least all of the advanced play eligible players are identified and the register 20 completed. The seal window 26 is then opened to identify the seal winner, who receives the prize amount 28 (e.g. $300) associated with the seal window 26. The seal winner then opens one advanced level seal window 34 of the three comprising the first level 36*a*. If he or she exposes an advance symbol 40, e.g., the "Mountain Climber" icon, he or she receives the award amount 38*a*(e.g. $150) associated with the first level and is entitled to open one of the three seal windows 34 in the second level 36*b*. Otherwise, a player qualified for advanced play with an associated registration number 24 receives the first level award amount 38*a*and is entitled to open a seal window 34 in the second level 36*b*. Advanced play continues until a respective seal window 34 is opened in each of the three advanced levels 35*a*, 35*b*, 35*c*.

Game interest is thus maintained among the players qualified for advanced play since any one of them may be identified as either the seal winner or the winner at one or more of the advance levels. Although a single player could win the seal winner award 28 plus all three of the advanced level awards 38*a*, 38*b*, 38*c*, more probably additional players qualified for advanced play will participate therein. The player interest is thus maintained throughout the advanced play phase of the game. Another advantage to this game method is that a relatively large total prize amount, e.g., $1000 in the disclosed embodiment, can be advertised on the individual play cards 4, the seal card 6 and on promotional literature and represents the cumulative amount which would be won by a player winning all four of the advanced phase awards. Still further, player participation is involved at the advanced phase since players pick the windows in the various levels 36*a,b,c*.

In addition to the game 2 disclosed, other variations could be produced which embody the present invention. For example, the advanced level grid of nine seals arranged in three rows of three each could be provided on a separate card for optional play at the discretion of the operator. Moreover, the card counts and the award amounts could be adjusted as desired. Still further, different grid sizes with different numbers of windows 34 in each row and different numbers of advanced play levels could be provided.

The seal card 6 can be manufactured in a manner similar to the individual play cards 4 with laminated construction comprising a base layer 42*a* with the seal winner registration number 30, the concealed registration numbers 24 and the advance symbol 40 printed thereon and covered by upper layer 42*b* with other information printed thereon, including the sign-up register 20, the seal winner award amount 28, the advanced level award amounts 38*a*, 38*b*, 38*c*, a reproduction of the individual play card front faces 8*a* and graphics designed to promote and enhance game play.

It is to be understood that while certain forms of the present invention have been illustrated and described herein, it is not to be limited to the specific forms or arrangement of parts described and shown.

What is claimed and desired to be secured by Letters Patent is as follows:

1. A seal card game with random advanced player selection, which includes;

(a) a plurality of individual play cards each including;

(1) a plurality of symbol combinations;

(2) a plurality of break-open windows each having open and closed positions respectively revealing and concealing a respective symbol combination;

(3) a plurality of graphic symbol combinations designating instant winners, each said winning graphic symbol combination corresponding to a respective instant winner award amount; and (4) a plurality of numerical symbol combinations comprising multiple-digit numerals and qualifying respective cardholders for advanced level play; and (b) a master seal card, including:

(1) a sign-up register with said advanced play qualification symbol combinations;

(2) a plurality of player signature lines adjacent respective advanced play qualification symbol combinations for signing by advanced play qualification symbol combination cardholders;

(3) a seal award winner symbol combination corresponding to a respective advanced play qualification symbol combination and a seal award window having open and closed positions respectively revealing and concealing said seal award symbol combination;

(4) a seal winner award amount payable to said seal winner symbol combination cardholder;

(5) a plurality of advanced play levels arrayed in a grid comprising a plurality of rows each corresponding to a respective advanced play level and including a plurality of break-open windows each having open and closed positions respectively revealing and concealing symbols thereunder, one of said windows in each level having a win symbol thereunder comprising a respective advanced play qualification symbol combination; each said win symbol identifying a player who has the individual play card with the corresponding advanced play qualifying symbol combination as the winner of a respective award value associated with said level and as being entitled to pick a window at the next level, if any:

(6) said win symbols only appearing once each in said grid;

(7) a plurality of identical advance indicator symbols unique from said win symbols, one of said advance indicator symbols being printed in each row and selectively concealed under a respective break-open window; and (8) said advanced play levels having progressively higher award amounts associated therewith.

* * * * *